US006105188A

United States Patent [19]

Perez-Mesa et al.

[11] Patent Number: 6,105,188

[45] Date of Patent: Aug. 22, 2000

[54] NAP-SAC CARRYING POUCH AND CHILD SLEEPING SYSTEM

[76] Inventors: Amelia Perez-Mesa, 10010 SW. 108 St., Miami, Fla. 33176; Ivonne Suarez, 765 NW. 122 Ct., Miami, Fla. 33182

[21] Appl. No.: 09/260,825

[22] Filed: Mar. 2, 1999

[51] Int. Cl.[7] ..... A47C 20/02

[52] U.S. Cl. ..... 5/655; 5/417; 5/413 R; 383/4

[58] Field of Search ..... 5/413 R, 417, 5/419, 420, 655, 499; 383/15, 4, 2; 190/2; 40/586

[56] References Cited

U.S. PATENT DOCUMENTS

| | | | |
|---|---|---|---|
| 3,774,249 | 11/1973 | Ybarra et al. | 5/417 |
| 3,784,084 | 1/1974 | Pearl | 229/54 R |
| 4,606,290 | 8/1986 | Marzotto | 5/499 |
| 4,984,906 | 1/1991 | Little | 5/420 |
| 5,172,440 | 12/1992 | Ming | 5/417 |
| 5,644,807 | 7/1997 | Battistella | 5/417 |
| 5,692,257 | 12/1997 | Albertieri | 5/655 |
| 5,785,219 | 7/1998 | Kraft | 224/576 |
| 5,987,667 | 11/1999 | Haverly et al. | 5/417 |

*Primary Examiner*—Terry Lee Melius
*Assistant Examiner*—James M Hewitt

[57] ABSTRACT

A nap-sac carrying pouch and child sleeping system including a base blanket in a generally rectangular configuration having a length and a width. A cover blanket is in a generally rectangular configuration and has a length and width essentially equal to that of the base blanket. A carrying pouch is formed of two rectangular sections. One of the rectangular sections is coextensive with the upper central section of the base blanket. The carrying pouch is adapted to receive the base and cover blankets when folded in equal sections along its length and is adapted to receive the base blanket and cover blanket when its lateral sides are folded over. The two rectangular sections of the carrying pouch are coupled along a bottom edge and two parallel side edges. An open top edge receives the folded base blanket and cover blanket. The bottom edge and side edge of the carrying pouch are coupled to a central extent of the upper edge of the base blanket.

17 Claims, 6 Drawing Sheets

22
16
40
30
18
32
14
20
24

NAP-SAC CARRYING POUCH AND CHILD SLEEPING SYSTEM

BACKGROUND OF THE INVENTION

1. Field of the Invention

The present invention relates to a nap-sac carrying pouch and child sleeping system and more particularly pertains to increasing the convenience and comfort of children at day care centers/preschools or other locations wherein rest might be desired.

2. Description of the Prior Art

The use of child care systems of known designs and configurations is known in the prior art. More specifically, child care systems of known designs and configurations heretofore devised and utilized for the purpose of rendering children comfortable through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,588,749 to Ishikawa discloses a multifunctional bag. U.S. Pat. No. 4,375,111 to Hall discloses a convertible mat and carrying bag combination. U.S. Pat. No. 4,774,734 to Mills discloses a convertible sleeping bag and stuffed toy. Lastly, U.S. Pat. No. 3,774,249 to Ybarra et al discloses a foldable mat.

While these devices fulfill their respective, particular objectives and requirements, the aforementioned patents do not describe a nap-sac carrying pouch and child sleeping system that allows increasing the convenience and comfort of children at day care centers/preschools or other locations wherein rest might be desired.

In this respect, the nap-sac carrying pouch and child sleeping system according to the present invention substantially departs from the conventional concepts and designs of the prior art, and in doing so provides an apparatus primarily developed for the purpose of increasing the convenience and comfort of children at day care centers or other locations wherein rest might be desired.

Therefore, it can be appreciated that there exists a continuing need for a new and improved nap-sac carrying pouch and child sleeping system which can be used for increasing the convenience and comfort of children at day care centers or other locations wherein rest might be desired. In this regard, the present invention substantially fulfills this need.

SUMMARY OF THE INVENTION

In view of the foregoing disadvantages inherent in the known types of child care systems of known designs and configurations now present in the prior art, the present invention provides an improved nap-sac carrying pouch and child sleeping system. As such, the general purpose of the present invention, which will be described subsequently in greater detail, is to provide a new and improved nap-sac carrying pouch and child sleeping system and method which has all the advantages of the prior art and none of the disadvantages.

To attain this, the present invention essentially comprises a base blanket. The base blanket is in a generally rectangular or square configuration. The base blanket has a length of about 52 inches and a width of about 30 inches. The blanket has primary fasteners on its upper surface along one long edge thereof and one fastener on the top right hand corner for easy folding. Next provided is a cover blanket. The cover blanket is in a generally rectangular or square configuration. The cover blanket has a length and width essentially equal to that of the base blanket. The cover blanket has secondary fasteners on its lower surface along one edge thereof and one fastener on the top right hand corner. The secondary fasteners are in removable coupling relationship with respect to the fasteners of the base blanket. Next provided is a carrying pouch. The carrying pouch is formed of two rectangular or square sections. One of the rectangular or square sections is coextensive with the upper central section of the base blanket. The carrying pouch has a length of about 14½ inches to receive the base and cover blankets when folded in four equal sections along its length. The carrying pouch has a width of about 14½ inches and is adapted to receive the base blanket and cover blanket when each fourth of its lateral sides are folded over. The two rectangular or square sections of the carrying pouch are coupled along a bottom edge and two parallel side edges. The two rectangular or square sections have an open top edge for receiving the folded base blanket and cover blanket. The bottom edge and side edges of the carrying pouch are coupled to a central extent of the upper edge of the base blanket. Next provided are two semicircular handles. The handles extend upwardly from each top edge of the carrying pouch section. Each handle has a centrally located releasable fastener. A pillow is releasably positioned within the pocket when deployed for operation and use. A large utility pocket is provided and includes an open upper edge coupled to the exterior surface of one of the sections of the carrying pouch.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved nap-sac carrying pouch and child sleeping system which has all of the advantages of the prior art child care systems of known designs and configurations and none of the disadvantages.

It is another object of the present invention to provide a new and improved nap-sac carrying pouch and child sleeping system which may be easily and efficiently manufactured and marketed.

It is further object of the present invention to provide a new and improved nap-sac carrying pouch and child sleeping system which is of durable and reliable constructions.

An even further object of the present invention is to provide a new and improved nap-sac carrying pouch and child sleeping system which is susceptible of a low cost of manufacture with regard to both materials and labor, and which accordingly is then susceptible of low prices of sale to the consuming public, thereby making such nap-sac carrying pouch and child sleeping system economically available to the buying public.

Even still another object of the present invention is to provide a nap-sac carrying pouch and child sleeping system for increasing the convenience and comfort of children at day care centers/preschools or other locations wherein rest might be desired.

Lastly, it is an object of the present invention to provide a new and improved carrying pouch and child sleeping system including a base blanket in a generally rectangular or square configuration having a length and a width. A cover blanket is in a generally rectangular or square configuration having a length and width essentially equal to that of the base blanket. A carrying pouch is formed of two rectangular or square sections. One of the rectangular or square sections is coextensive with the upper central section of the base blanket. The carrying pouch is adapted to receive the base and cover blankets when folded in equal sections along its length and adapted to receive the base blanket and cover blanket when its lateral sides are folded over. The two rectangular or square sections of the carrying pouch are coupled along a bottom edge and two parallel side edges with an open top edge for receiving the folded base blanket and cover blanket. The bottom edge and side edges of the carrying pouch are coupled to a central extent of the upper edge of the base blanket.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 8 is a perspective view of the releasably coupling arrangement between the cover blanket and the base blanket and the like.

The same reference numerals refer to the same parts through the various Figures.

DESCRIPTION OF THE PREFERRED EMBODIMENT

Figure 1:
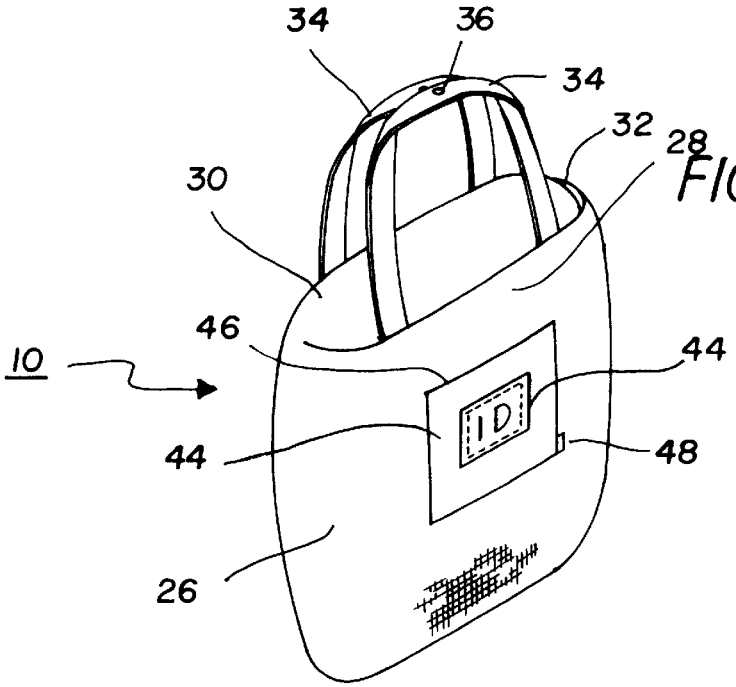
FIG. 1 is a perspective view of the preferred embodiment of the new and improved nap-sac carrying pouch/child sleeping system constructed in accordance with the principles of the present invention.
Figure 2:
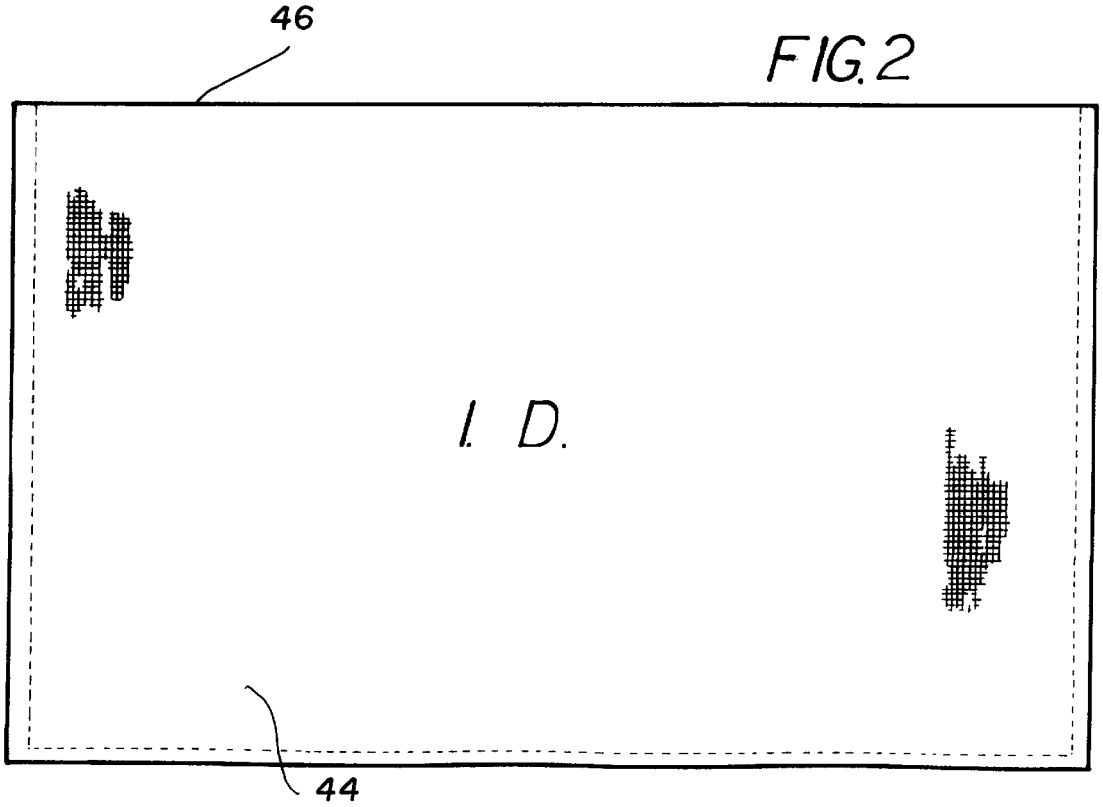
FIG. 2 is a front elevational view of the central portion of the system shown in FIG. 1.
Figure 3:
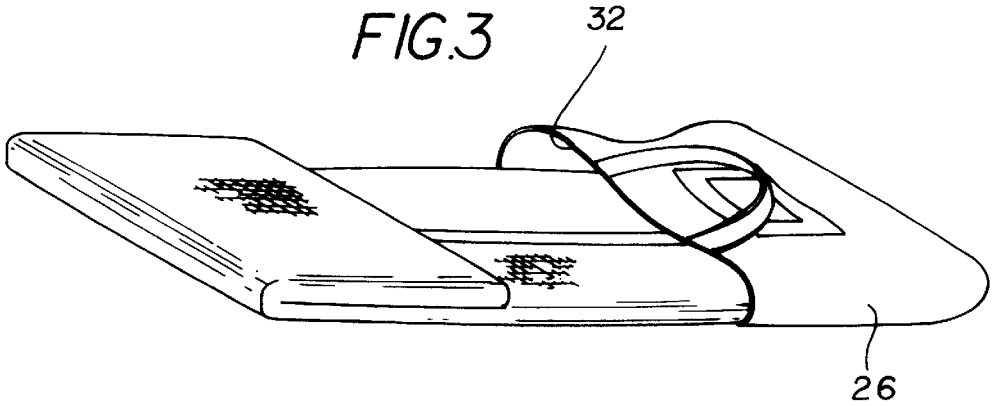
FIG. 3 is a perspective illustration of the system partially disassembled.

With reference now to the drawings, and in particular to FIG. 1 thereof, the preferred embodiment of the new and improved nap-sac carrying pouch and child sleeping system embodying the principles and concepts of the present invention and generally designated by the reference numeral 10 will be described.

Specifically, it will be noted in the various Figures that the present invention, the nap-sac carrying pouch and child sleeping system is comprised of a plurality of components. Such components in their broadest context include a base blanket, a cover blanket, carrying pouch and utility pocket. Such components are individually configured and correlated with respect to each other so as to attain the desired objective.

The base blanket 14 is in a generally rectangular or square configuration. The base blanket in the primary embodiment has a length of about 52 inches and a width of about 30 inches. The blanket has primary fasteners 16 on its upper surface along one long edge thereof and one single fastener 18 on the other top edge.

The cover blanket 20 is in a generally rectangular or square configuration. The cover blanket preferably has a length and width essentially equal to that of the base blanket. The cover blanket has secondary fasteners 22 on its lower surface along one edge thereof and one single fastener 24 on the top right corner edge. The secondary fasteners are in removable coupling relationship with respect to the primary fasteners of the base blanket.

A carrying pouch 26 is formed of two rectangular, preferably square, sections 28, 30. One of the square sections 30 is coextensive with and part of the upper central section of the base blanket. Section 28 is a separate piece of fabric stitched around three sides of its periphery to the base blanket but not stitched along the edge remote from the upper edge of the base blanket. When in the carrying mode, this unstitched edge forms the opening for the pouch with the logo exposed. When in the operational mode for sleeping, section 28 is on the lower surface of the base blanket with logo on the inside and, preferably, with the pillow therein.

The carrying pouch has a length of about 14½ inches to receive the base and cover blankets when folded in four equal sections along its length. The carrying pouch has a width of about 14½ inches and is adapted to receive the base blanket and cover blanket when each fourth of its lateral sides are folded over. The two square sections 28, 30 of the carrying pouch are coupled along a bottom edge and two parallel side edges. The two square pouch sections 28, 30 have an open top edge 32 for receiving the folded base blanket and cover blanket. The bottom edge and side edges of the carrying pouch are coupled to a central extent of the upper edge of the base blanket. The fabric sections which make up the pouch are moved between an inside out configuration and an outside in configuration as the system converts between the sleeping orientation wherein the pouch receives the pillow and the conveying orientation wherein the pouch received the folded blankets.

Two semi-circular handles 34 extend upwardly from each top edge of the carrying pouch section. Each handle has a centrally located releasable fastener 36. A pillow 40 is releasably positioned within the pocket when deployed for operation and use. A large utility pocket 44 is provided and includes an open upper edge 46 coupled to the exterior surface of one of the sections of the carrying pouch. The exterior surface of the large utility pocket is preferably provided with indicia as for personal identification purposes.

Figure 6:
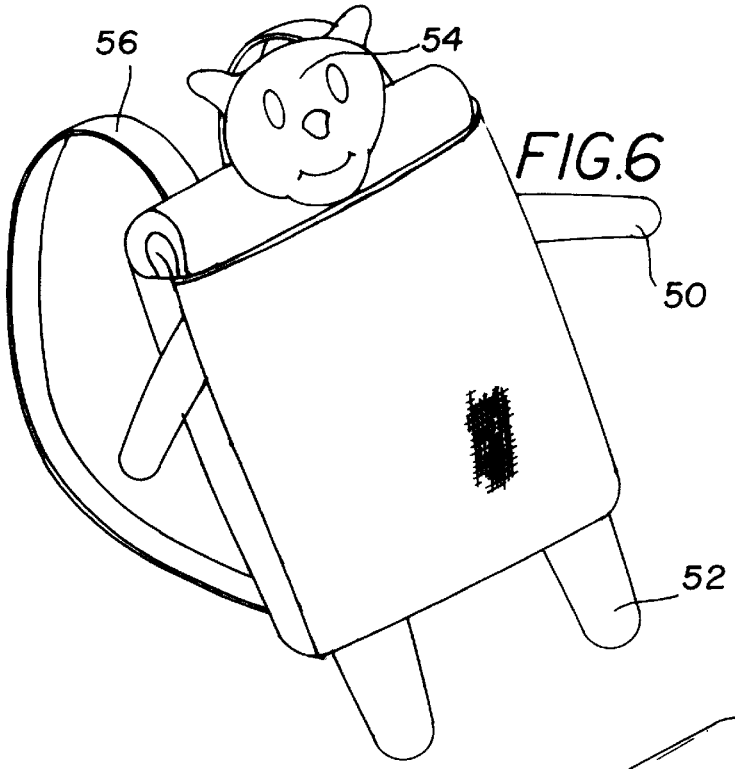
FIG. 6 illustrates an alternate embodiment of the invention wherein the pouch is provided with additional components, and with straps for carrying on a user's back.

Illustrated in FIG. 6 is an alternate embodiment which shows arms 50 and legs 52 of a small animal extending from the sides and bottom with a head 54 extending upwardly from the upper edge. These additional components to the nap-sac could be permanently secured thereto as by stitching or removably coupling as by removable fasteners such as Velcro, zippers, buttons or the like. This embodiment is also provided with two shoulder straps 56 for carrying purposes rather than the carrying straps coupled together.

Figure 7:
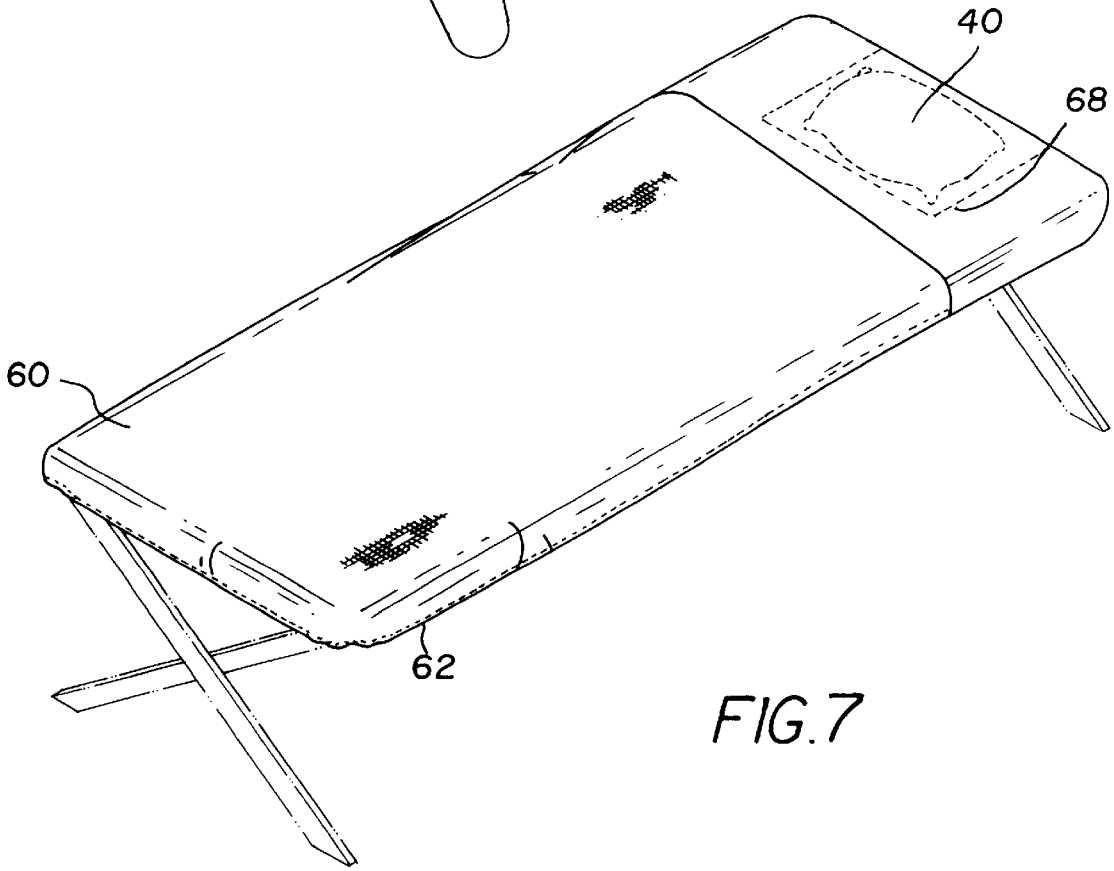
FIG. 7 is a further alternate embodiment of the invention wherein additional material is provided around the periphery for use in the nature of a fitted sheet.

Shown in FIG. 7 is another alternate embodiment of the invention. Such embodiment is constructed with the entire or partial peripheral edge having additional material 60 hanging down with a resilient elastic thread, band, cord or string 62 at the lower free peripheral edge so that the device can be deployed onto a cot like a fitted sheet.

Figure 5:
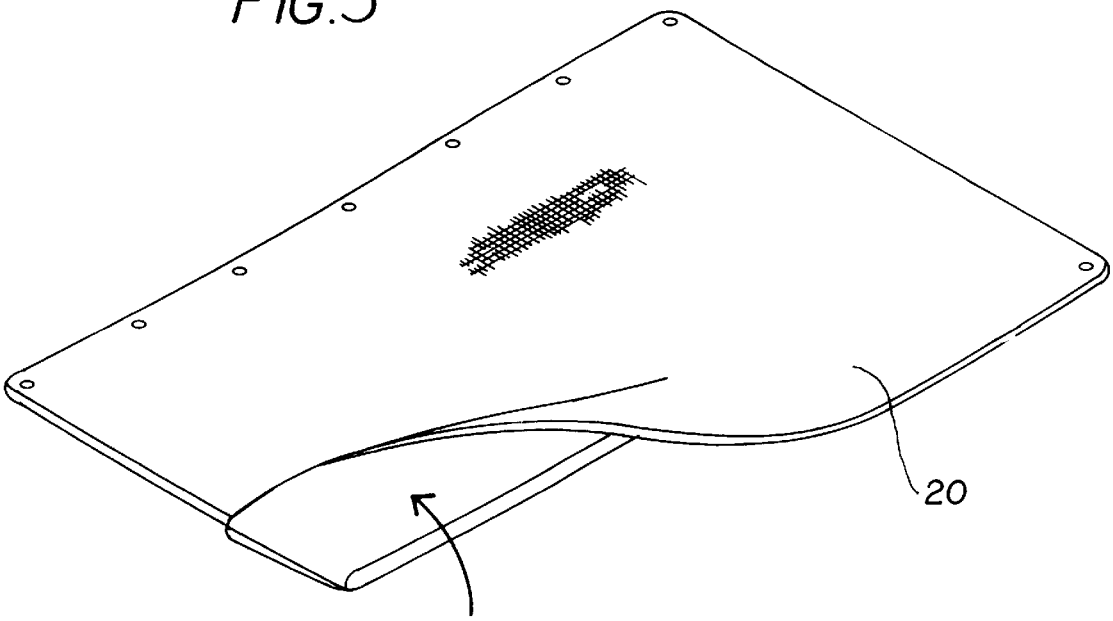
FIG. 5 is a view similar to FIG. 4 but with the device shown in a partially folded orientation.
Figure 4:
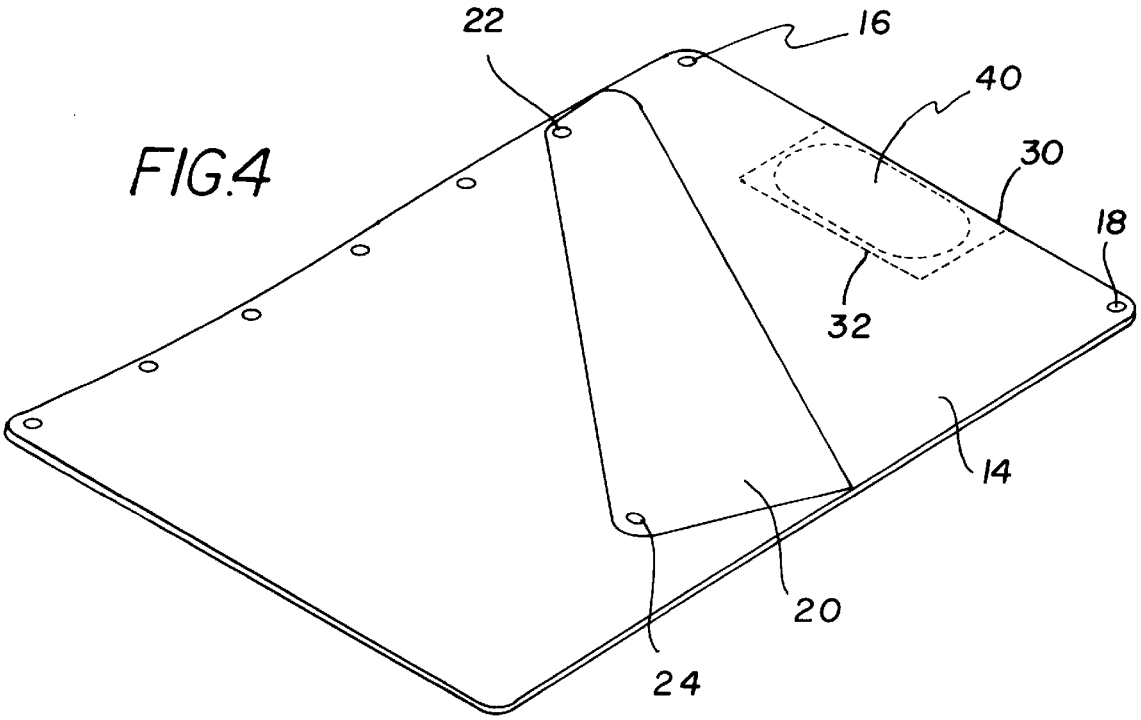
FIG. 4 is a view of the system ready for operation and use but with the blanket shown in a partially folded down orientation with the pillow in the pocket.
Figure 8:
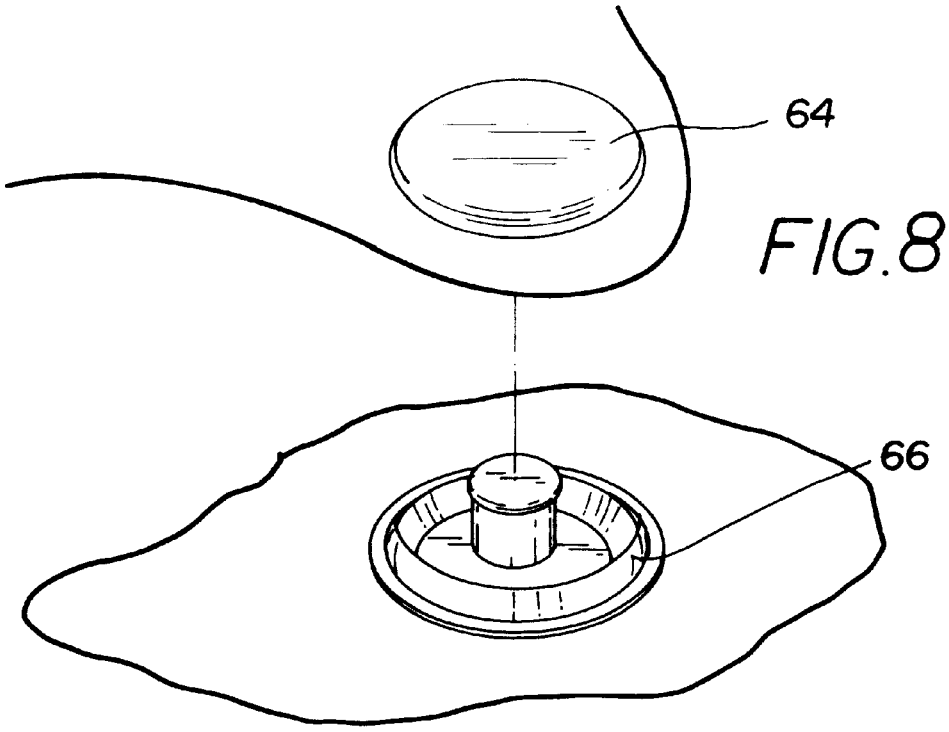

FIG. 8 shows releasable fasteners 64, 66 which may be utilized for coupling the two blankets of FIGS. 4 and 5. Such releasable fasteners could also be utilized at the top of the straps of FIG. 1 to hold the straps together during the carrying function. Such releasable fasteners could also be utilized to hold the corners 68 of the pillow in position within the pouch when deployed for sleeping purposes.

Figure 9:
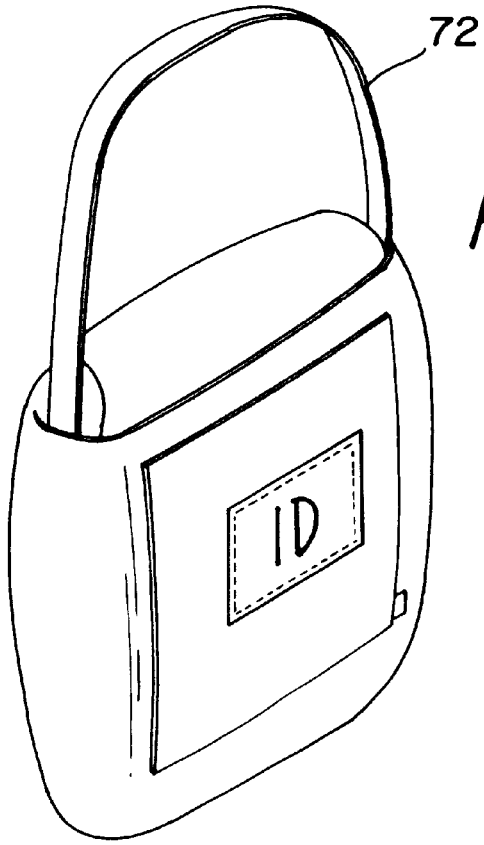
FIG. 9 is yet a further alternate embodiment of the invention wherein a single carrying strap is utilized.

FIG. 9 is a further embodiment of the invention. Such embodiment is similar to that of FIGS. 1–5. In such FIG. 9 embodiment, however, the dual straps of FIG. 1 are replaced by a single carrying strap 72, preferably longer, if such is the preference of the user.

Figure 10:
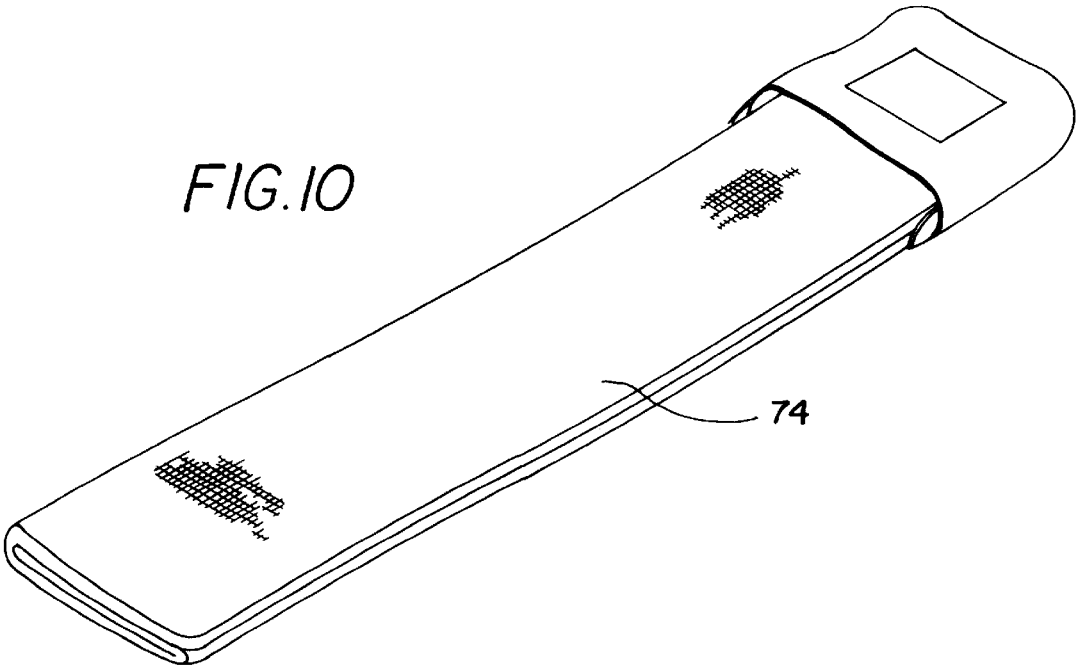
FIGS. 10 and 11 illustrate a final alternate embodiment of the invention constructed of an enlarged size.
Figure 11:
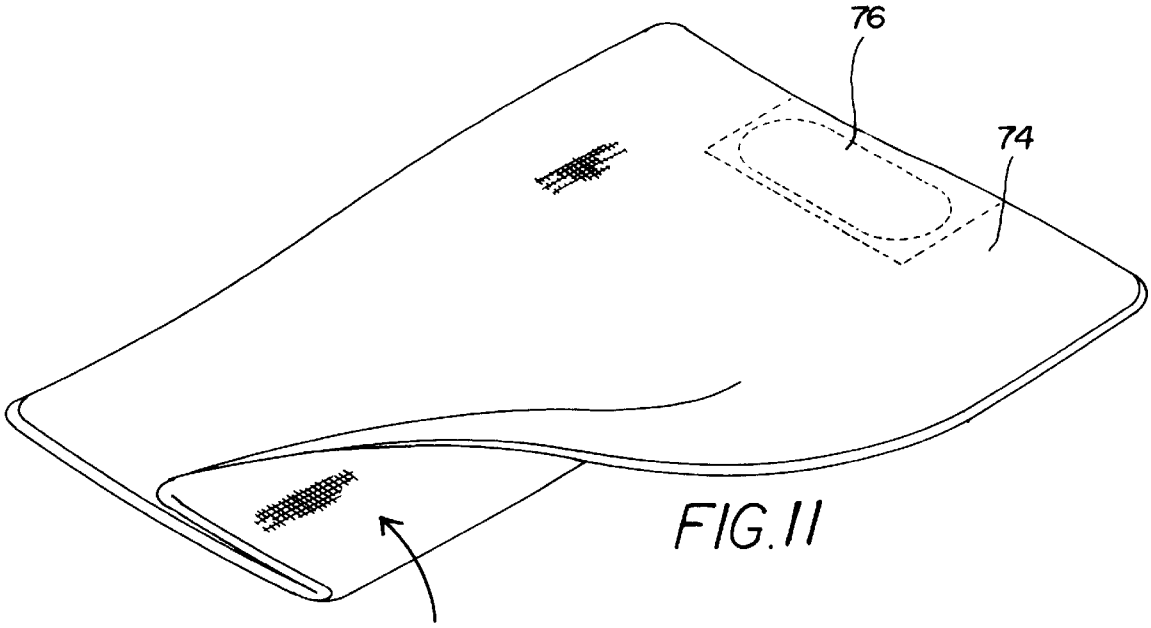

The final embodiment of the invention is shown in FIGS. 10 and 11. In such embodiment, the base blanket is of an enlarged size. Such size is of an extent whereby one-third of the left side may be folded over the center third and one-third of the right side may be folded over the central third. As a result, when folded laterally, there would be three layers of base blanket to be folded into four sections and placed within the pouch. This is different from the prior embodiments wherein one-third of each lateral side is folded over onto the middle one-third of the base blanket and, as a result, three layers of base blanket are provided prior to folding and insertion into the pouch. As a result, when folded laterally, there would be three layers of base blanket to be folded into three sections and placed within the pouch. Further, in this embodiment, the cover blanket may be dispensed with or utilized in any of the embodiments described above.

In this final embodiment, the two parallel side edges of the pouch are coupled to the base blanket as in one adjacent edge. The other adjacent edge is not so coupled for forming an opening whereby the pouch may receive the folded blanket and/or pillow. In the prior embodiments, the opening between sections 28 and 30 is along a line spaced from the upper edge of the blanket. In the final embodiment of FIGS. 10, 11, the opening between sections 28 and 30 is along the upper edge of the blanket. As a last feature of the invention, it should be understood that the material of the entire device and system is preferably fabricated of a flame-retardant or flame-resistant material, although other materials, natural or synthetic or blends thereof could readily be utilized.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A nap-sac carrying pouch and child sleeping system comprising, in combination:

a base blanket with an upper surface and a lower surface in a generally rectangular configuration and having an upper edge and a lower edge defining a width of about 30 inches and having side edges with a length of about 52 inches, the base blanket having primary fasteners on its upper surface along one side edge thereof and another fastener on a corner on the other side edge of the base blanket;

a cover blanket with an upper surface and a lower surface in a generally rectangular configuration having a length and width essentially equal to that of the base blanket, the cover blanket having secondary fasteners on its lower surface along one side edge thereof in removable coupling relationship with respect to the primary fasteners of the base blanket;

a carrying pouch formed of two rectangular sections, one of the rectangular sections being coextensive with an upper central section of the base blanket, the carrying pouch being about 14½ inches in length to receive the base and cover blankets when the blankets are folded in four equal sections along their length and said pouch having a width of about 14½ inches adapted to receive the base blanket and cover blanket when each fourth of their side-edges are folded over, the two rectangular sections of the carrying pouch being coupled along a bottom edge and parallel side edges of the sections, the pouch having an open top edge on the lower surface of the base blanket remote from the upper edge of the base blanket for receiving the folded base blanket and cover blanket, the bottom edge and side edges of the carrying pouch being coupled to a central extent of the upper edge of the base blanket;

two semi-circular handles extending upwardly from each top edge of the carrying pouch, each handle having a centrally located releasable fastener;

a pillow releasably positioned within the pocket when the pouch is deployed for operation and use; and a large utility pocket with an open upper edge coupled to an exterior surface of one of the sections of the carrying pouch.

2. A carrying pouch and child sleeping system comprising:

a base blanket having a generally rectangular configuration and comprising an upper surface and a lower surface, an upper edge and a lower edge and side edges, the blanket having a length and a width; and a carrying pouch formed of two rectangular sections, one of the rectangular sections being coextensive with a central section of the base blanket, the carrying pouch being adapted to receive the base blanket when the base blanket is folded in equal sections along its length and adapted to receive the base blanket when the side edges of the base blanket are folded over, the two rectangular sections of the carrying pouch each having an upper edge and a lower edge and two side edges and being coupled along the lower edges and the side edges to form said pouch of the pouch, said pouch having an open top edge on the lower surface of the base blanket for receiving the folded base blanket, the bottom edge and side edge of the carrying pouch being coupled to a central extent of the upper edge of the base blanket.

3. The system as set forth in claim 2 and further including a cover blanket positionable over the base blanket on the upper surface.

4. The system as set forth in claim 3 wherein the cover blanket is coupled to the base blanket on at least one side edge of the base blanket.

5. The system as set forth in claim 4 wherein the coupling of the base blanket and the cover blanket is effected through releasable fasteners.

6. The system as set forth in claim 2 and further including a pair of carrying straps coupled to the pouch.

7. The system as set forth in claim 6 and further including releasable fasteners secured to the straps for coupling purposes.

8. The system as set forth in claim 2 and further including a utility pocket in a rectangular configuration coupled at three edges to an exterior surface of the pouch.

9. The system as set forth in claim 8 and further including indicia on the utility pocket.

10. The system as set forth in claim 2 and further including a pillow removably positionable within the pouch.

11. The system as set forth in claim 10 and further including releasable couplers on the pillow and interior of the pouch for releasable coupling between the pillow and the pouch.

12. The system as set forth in claim 2 wherein the folding of the base blanket is effected by folding one-fourth of each side edge over the central section prior to folding into the pouch.

13. The system as set forth in claim 2 wherein the folding of the base blanket is effected by folding one-third of each side edge over the central section prior to folding into the pouch.

14. The system as set forth in claim 2 and further including fabric arms, legs and head coupled to the pouch.

15. The system as set forth in claim 2 and further including fabric extending downwardly from the edges of the base blanket with a resilient member at an end for coupling to a cot.

16. The system as set forth in claim 15 wherein the downwardly extending fabric and resilient member extends around edges.

17. The system as set forth in claim 2 and further including a single elongated carrying strap coupled with respect to the open top edge of the pouch.

* * * * *